United States Patent [19]

Botos et al.

[11] 4,031,887

[45] June 28, 1977

[54] BREATHING APPARATUS PROVIDING PRESSURE COMPENSATION

[75] Inventors: Imre Botos, Lidingo; Ivan Aldine Hellquist, Rotebro, both of Sweden

[73] Assignee: AGA Aktiebolag, Sweden

[22] Filed: Feb. 26, 1976

[21] Appl. No.: 661,490

[30] Foreign Application Priority Data

Mar. 14, 1975 Sweden ..... 7502855

[52] U.S. Cl. ..... 128/142 R

[51] Int. Cl.[2] ..... A62B 7/02

[58] Field of Search ..... 128/142 R, 142.2, 142.3, 128/146.5, 202, 203, 147, 204, 145 R, 191 R

[56] References Cited

UNITED STATES PATENTS

| | | | |
|---|---|---|---|
| 3,200,816 | 8/1965 | Bartlett, Jr. | 128/142.2 |
| 3,827,432 | 8/1974 | Lundgren et al. | 128/142.2 |
| 3,923,053 | 12/1975 | Jansson | 128/142 R |

*Primary Examiner*—Robert W. Michell
*Assistant Examiner*—Henry J. Recla
*Attorney, Agent, or Firm*—Larson, Taylor and Hinds

[57] ABSTRACT

Breathing apparatus is provided for use under water, in a noxious atmosphere or under like conditions, which provides pressure compensation during release of the consumed breathing gas. The apparatus includes a connection device such as a breathing mask for connecting the apparatus to the breathing organs of a user and a breathing circuit which communicates with the connection device and includes a carbon-dioxide absorber and an expansible gas chamber. The apparatus includes controls which, during the operation of the breathing circuit, provide (i) a first operating period wherein the breathing circuit is closed and a breathing gas is caused to circulate in the breathing circuit until the oxygen concentration of the circulating breathing gas is reduced to a predetermined value and (ii) a second operating period which alternates with the first period, wherein the used breathing gas is released to the ambient environment and fresh gas is supplied to the breathing circuit. A dosing container is connected to the breathing circuit which, during the first operating period, receives fresh gas therein having a predetermined pressure exceeding the pressure of the breathing circuit. During the second operation period, the dosing container supplies the contents thereof to the breathing circuit, at the same time as the volume of the expansible gas chamber is increased, until the pressure in the dosing container is substantially equal to the pressure in the breathing circuit.

8 Claims, 2 Drawing Figures

BREATHING APPARATUS PROVIDING PRESSURE COMPENSATION

FIELD OF THE INVENTION

The present invention relates to breathing apparatus for use under water, in a noxious atmosphere or under like conditions.

BACKGROUND OF THE INVENTION

The present invention concerns an improvement in breathing apparatus of the type used under water or in a noxious atmosphere and including a connection device, such as a helmet, face mask or a mouth piece, which is adapted to communicate with the breathing organs of a user. The breathing apparatus also includes a breathing circuit in communication with the connection device and including a carbon-dioxide filter or absorber and an expansible gas chamber such as a breathing bag or a bellows. The apparatus also includes suitable controls which provide alternating periods of operation. During a first operating period, the breathing circuit is closed and the breathing gas is caused to circulate in the breathing circuit, while carbon-dioxide is absorbed, until the concentration of oxygen in the circulating breathing gas is reduced to a predetermined value. During the second operating period of the cycle, consumed breathing gas is blown out or released into the surroundings and fresh gas is supplied to the breathing circuit. A breathing apparatus of this type is disclosed in U.S. Pat. No. 3,827,432 (Lundgren et al.) and the contents of this patent are incorporated by reference. This type of apparatus possesses a number of important advantages. For example, the apparatus consumes extremely small amounts of gas irrespective of the diving depth and the percentage of the oxygen used can be maintained within narrow limits. However, the use of an apparatus of this type under certain circumstances has proved to be tiring since replacement of the breathing gas in the re-breathing system involves, to a great extent, active cooperation of the person using the breathing apparatus.

SUMMARY OF THE INVENTION

The disadvantages of the prior art are overcome by the breathing apparatus of the present invention. Generally speaking, the present invention concerns the provision of a dosing bottle or dosing container connected to the breathing circuit of a breathing apparatus of the type discussed above. During the first operating period of the operating cycle of the breathing apparatus, the dosing bottle is filled with fresh gas having a predetermined pressure exceeding the pressure of the breathing circuit. During the second operating period, the contents of the dosing bottle are released or emptied into the breathing circuit, while the volume is increased in the expansible gas chamber, until the pressure in the dosing bottle is substantially equal to the pressure in the breathing circuit.

The apparatus preferably includes a valve disposed in the connection between the dosing bottle and the breathing circuit which is arranged to be controlled by a device which measures the gas volume that is passed through the breathing circuit during the first operating period. In accordance with one embodiment, the dosing bottle is filled during the first operating period from a gas container through a pressure reducing primary pressure regulator and a current restricting throttle. In accordance with the second embodiment, the dosing bottle is filled during the first operating period from a gas container through a pressure reducing primary pressure regulator and a valve controlled responsive to the movements of the expansible chamber.

Other features of the invention will be set forth in, or apparent from, a detailed description of the preferred embodiments of the invention found hereinbelow.

DESCRIPTION OF THE PREFERRED EMBODIMENTS

Figure 1:
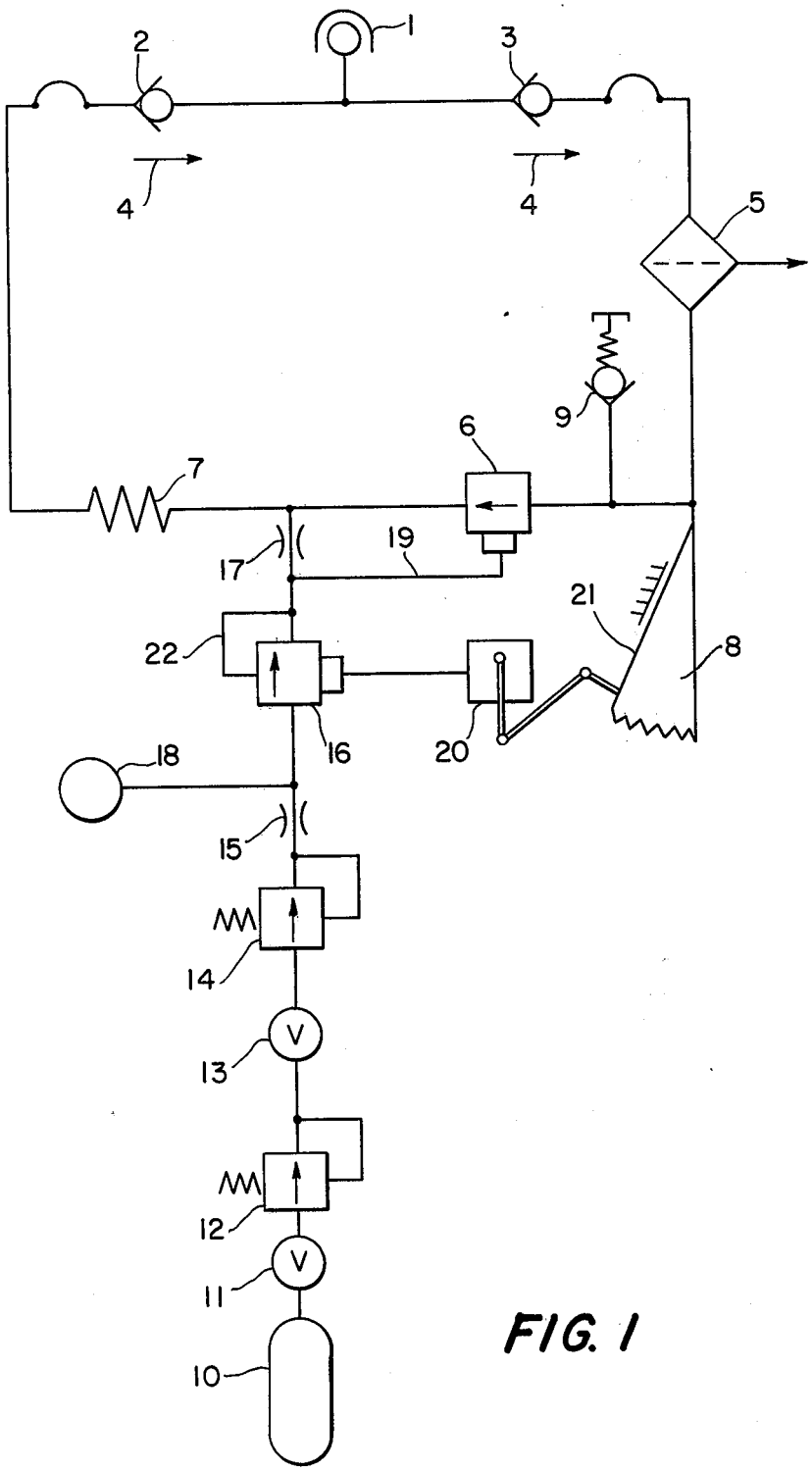
FIG. 1 is a schematic diagram of a first embodiment of a breathing apparatus in accordance with the invention.

Referring to FIG. 1, a connection device, such as a breathing mask, which provides communication with the breathing organs of a user, is generally denoted 1. Breathing mask 1 may, in accordance with a conventional construction, comprise an outer mask having an eye shield and an inner mask which covers the nose and mouth of the user. Breathing mask 1 is connected to a breathing circuit which includes a pair of non-return valves 2 and 3 which, during inhalation and exhalation, cause a gas flow in the breathing circuit in the direction of arrows 4. The breathing circuit also includes an absorber or filter 5 which absorbs carbon-dioxide, a controllable valve 6 and an optional reservior 7 which may be omitted. An expansible chamber 8, in the form of a bellows, a breathing bag or the like, is connected to the breathing circuit. In addition, a loaded or biased output valve 9 is connected to the breathing circuit at a point between the carbon-dioxide absorber 5 and the controllable valve 6.

Fresh gas is supplied to the breathing circuit from a container 10. This fresh gas, preferably comprises a suitable mixture of oxygen and nitrogen which, for example, may be in the same proportions as in common air. It will be appreciated that other proportions may also be used under certain circumstances and, for example, a higher percentage of oxygen may be desirable in some applications. Fresh gas container 10 is connected to the breathing circuit through a shut-off valve 11, a primary pressure regulator 12, a second valve 13, a secondary pressure regulator 14, a throttle 15, a servo-controlled valve 16, and a second throttle 17. Throttle 17 is connected to the breathing circuit at a point between the controllable valve 6 and the reservoir 7.

A dosing bottle 18 is connected to a point in the connection between the fresh gas container 10 and the breathing circuit, and, more particularly, to a point between the throttle 15 and the valve 16. In addition, a safety valve (not shown) may also be connected to this point and a second safety valve (not shown) may be connected to a point between the shut-off valve 13 and the secondary pressure regulator 14. A conduit or connection 19 between valve 6 and a point between the connection between valves 16 annd throttle 17 provides control of valve 6 by the pressure at the outlet of valve 16. Servo-controlled valve 16 is adjusted in relationship to the volume of breathing gas which is circulated in the breathing circuit during the first operating period wherein the breathing circuit is closed. To this end, a control unit 20 is connected to a movable wall 21 of bellows 8 which controls valve 16 in accordance with the pressure within bellows 8. In a manner which is described in more detail in U.S. Pat. No. 3,827,432, referred to above, the control unit 20 may be constructed so that valve 16 is adjusted for the purpose of opening the breathing circuit either after a predetermined volume has been re-breathed or after a predetermined number of re-breathing cycles. When valve 16 is actuated, a direct connection is provided from throttle 15 to throttle 17.

The apparatus described above operates as follows. It is initially assumed that valve 6 of the breathing circuit is open and the servo-valve 16 is closed so that the breathing circuit forms a closed loop. The exhalation gas from the mask 1 is channeled by the non-return valves 2 and 3 through the absorber 5 to the bellows 8. The inhalation gas from the bellows 8 passes through valve 6, the reservoir 7 and the non-return valve 2, to the breathing mask 1 to complete the loop. During re-breathing, the dosing bottle 18 is filled with fresh gas which is supplied thereto from the fresh gas container 10 through the valve 11, the primary pressure regulator 12, the valve 13, the secondary pressure regulator 14 and the throttle 15. Thus, the dosing bottle 18 is filled with fresh gas to a pressure which is essentially lower than the pressure in the fresh gas container 10 but is higher than the pressure in the breathing circuit.

When a predetermined volume of gas has passed through the closed loop breathing curcuit, the volume responsive control unit 20 causes actuation of the servo-valve 16 thereby permitting the gas stored in the dosing bottle to be released therefrom. The pressure thus created in advance of the throttle 17 causes closure of the pressure control valve 6 in the breathing circuit through means of the conduit 19.

The quantity of gas dosed or supplied from the dosing bottle 18 causes the transfer of a corresponding quantity of consumed or used gas, which is stored in the reservoir 7, and in the breathing circuit itself, to the outlet valve 9. Thus, the consumed gas is released into the ambient environment through the outlet valve 9. When the dosing bottle is emptied, so that the pressure in advance of the throttle 17 is decreased to a value which is approximately equal to the pressure in the breathing circuit, the servo-valve 16 closes. As indicated by conduit 22, actuation of servo-valve 16 is responsive to the pressure between the valve 16 and the throttle 17. With servo-valve 16 closed, the pressure control valve 6 again opens and the closedloop in the breathing circuit is again completed. It is noted that during the time in which fresh gas is supplied to the breathing circuit from the dosing bottle 18, further fresh gas is supplied through the throttle 15. By suitable dimensioning of throttle 15 in relationship to the other components of the system, the quantity of gas actually supplied through throttle 15 may be made to be negligible.

As is evident from the foregoing description of the operation of the apparatus of the invention, the supply of fresh air to the breathing circuit and the exhalation of consumed gas is carried out by means of the pressure which, during the first operating period, is created by the dosing bottle 18. Thus, no active cooperation from the user of the apparatus is required when fresh air is supplied to the breathing circuit or when the consumed breathing gas is blown out to the ambient.

The amount of refillment gas supplied from the dosing bottle 18 to the breathing circuit is determined by the volume of the dosing bottle 18 and by the pressure existing downstream of the throttle 15. Since this pressure may be considered to be constant, the amount of refillment gas is also constant and is thus independent of the depth under the water surface at which the apparatus is used.

Figure 2:
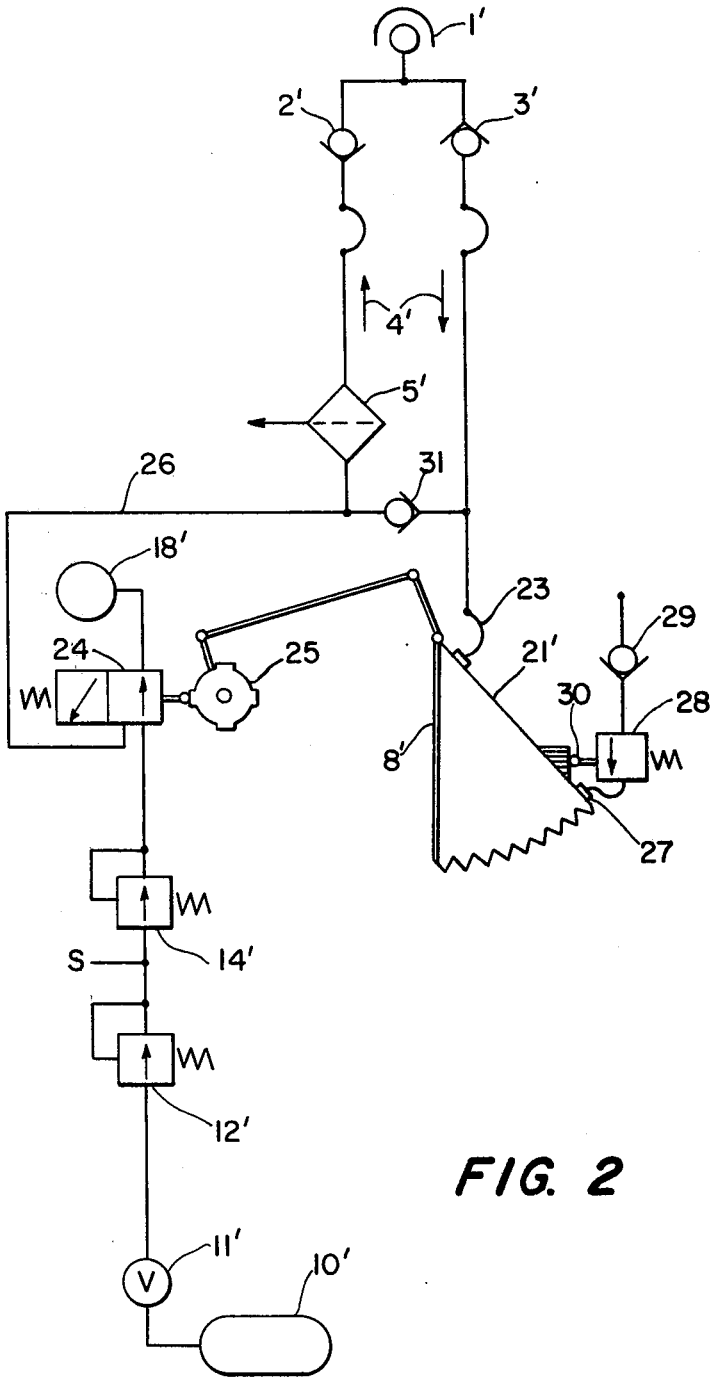
FIG. 2 is a schematic diagram of a second embodiment of the invention.

Referring to FIG. 2, an embodiment of the invention is shown which includes components which are common to the embodiment in FIG. 1 and which have been given the same numbers with primes attached. Thus, in the embodiment of FIG. 2, a breathing mask 1′ is connected to a breathing circuit which comprises a pair of non-return valves 2′ and 3′, and an absorber 5′. In addition, a non-return valve 31 is connected between a fresh gas supply conduit 26 and a conduit 23 which is connected to a bellows 8′. Similarly to the apparatus of the embodiment of FIG. 1, fresh gas is supplied from a container 10′ through a valve 11′, a primary pressure regulator 12′ and a secondary pressure regulator 14′. A valve unit 24 is connected downstream from pressure regulator 14′ which can be adjusted to one of two possible positions by means of a cam wheel 25. In the first position of valve unit 24, the output of the secondary pressure regulator 14′ is directly connected to the dosing bottle 18′ so that dosing bottle 18′ is filled with a predetermined amount of refillment gas. In the second position of valve unit 24, dosing bottle 18′ is directly connected to the breathing circuit through fresh gas supply conduit 26.

Rotation of cam wheel 25 is controlled responsive to the movement of the movable wall 21′ of bellows 8′ in a manner described in more detail in U.S. Pat. No. 3,827,432 referred to above and reference is made to that patent for a further description of this aspect of the embodiment of FIG. 2.

In order to release, or blow out, consumed breathing gas to the ambient environment, bellows 8′ is provided with a connection 27 through a controllable valve 28 and an outlet valve 29 which functions as a non-return valve. As is indicated by the connection rod 30, actuation of valve 28 is controlled responsive to the movement of movable wall 21′ of bellows 8′.

With the valves 24 and 28 in the position shown in FIG. 2, the dosing bottle 18 is connected to the fresh gas container 10′ so that the former is filled with a quantity of fresh gas which is determined by the volume of the dosing bottle 18′ and the pressure in the supply conduit therefor. At the same time, the breathing circuit including the non-return valves 2′, 3′, and 31 and the carbon-dioxide absorber 5′, is closed so that the exhalationn gas is blown out into the bellows 8′ and inhalation takes place from bellows 8′ through absorber 5′. During inhalation and exhalation, the wall 21′ of bellows 8′ moves further and further away from the rod 30 as oxygen is consumed in the breathing circuit. Under these circumstances, valve 28 is not actuated by means of rod 30. At this same time, the movement of wall 21′ causes rotation of cam wheel 25 in a manner described in more detail in U.S. Pat. No. 3,827,432 referred to above. After a predetermined rotation of cam wheel 25, valve unit 24 is actuated so that dosing bottle 18′ is disconnected from the fresh gas container and is connected to the breathing circuit through fresh gas conduit 26. Under these circumstances, the fresh gas stored in the dosing bottle 18′ is applied to the breathing circuit. Because of the provision of non-return valve 31, the gas from dosing bottle 18′ flows through the loop of the breathing circuit containing the absorber 5′ and vents into the bellows 8′ through conduit 23. As illustrated, conduit 23 is connected to the bellows 8' at a point remote from connection 27 and, consequently, when the bellows 8' has expanded to the extent that the movable wall 21' causes valve 28 to open, the incoming fresh gas will force out the consumed breathing gas through the connection 27 to vent through outlet valve 29.

It will be appreciated from the foregoing that the replacement of gas is performed as the quantity of fresh gas supply first fills a volume corresponding to that of the oxygen consumed and thereafter the excess fresh gas causes removal of the corresponding quantity of consumed breathing gas which exits through the outlet valve 29.

The interval during which the breathing circuit is closed and re-breathing is taking place, should be long enough that the gas in the breathing circuit has time sufficient to circulate the number of cycles required for the fresh gas supplied to the bellows 8' and the gas which is in the remainder of the breathing circuit to form a homogenuous mixture. This interval should also be sufficiently long to permit a complete filling of the dosing bottle 18'. The interval during which bottle 18' is connected to the breathing circuit should be sufficiently long to permit the bottle 18' to be emptied so that the pressure therein is equal to the pressure in the breathing circuit. In the embodiments of the invention described above, it has been assumed that the fresh gas is supplied from a separate fresh gas container 10'. The fresh gas can, however, also be supplied to the breathing apparatus from a hose, and in this case, the hose would be connected to a point S shown in FIG. 2 between the primary pressure regulator 12' and the secondary pressure regulator 14'. Further, the absorber 5' in the embodiment of FIG. 2 can be inserted in the conduit comprising the non-return valve 3.

Although the invention has been described relative to examplary embodiments thereof, it will be understood that other variations and modifications can be effected in these embodiments without departing from the scope and spirit of the invention.

We claim:

1. Breathing apparatus for use under water, in a noxious atmosphere or under like conditions, said apparatus comprising:

a container for breathing gas, a breathing circuit including connecting means, connected in said breathing circuit, for connection to the breathing organs of a user, carbon dioxide absorbing means connected in said breathing circuit and an expansible gas chamber connected in said breathing circuit, a conduit for supplying breathing gas from said breathing gas container to said breathing circuit, and means, including valve means connected in said conduit, for controlling the operation of said breathing circuit to provide (i) a first operating period wherein said breathing circuit form a closed breathing circuit and a breathing gas is caused to circulate in said breathing circuit until the oxygen concentration of the circulating breathing gas is reduced to a predetermined value and (ii) a second operating period, which alternates with said first operating period, wherein the used breathing gas is released to the ambient environment and fresh gas is supplied to the breathing circuit;

wherein the improvement comprises:

a dosing bottle, and means for, during the first operating period, connecting the bottle to the breathing gas container so as to store in the bottle fresh gas having a pressure exceeding the pressure in the breathing circuit and for, during the second operating period, connecting the bottle to the breathing circuit so as to supply the contents of the bottle to the breathing circuit and thus to the expansible gas chamber until the pressure in the dosing bottle is substantially equal to the pressure in the breathing circuit.

2. Breathing apparatus according to claim 1, further comprising means for measuring the volume of gas which is passed through the breathing circuit during the first operating period, said valve means comprising a valve, controlled by said measuring means, disposed in connection between the dosing bottle and the breathing circuit.

3. Breathing apparatus according to claim 2 further comprising means including a pressure reducing primary pressure regulator connected in series in said conduit and a valve connected to said conduit controlled responsive to movement of said expansible chamber for providing filling of said dosing bottle from a gas container during said first operating period.

4. Breathing apparatus according to claim 3 wherein said expansible gas chamber includes an inlet connected to said breathing circuit which is supplied with fresh gas from the dosing bottle through the breathing circuit and an outlet valve located in a different part of said expansible gas chamber through which consumed breathing gas is arranged to be blown out when the expansible gas chamber reaches the maximum volume thereof.

5. Breathing apparatus according to claim 4 further comprising a further conduit which provides communication between the expansible gas chamber and said conduit for supplying fresh gas for the breathing circuit and a non-return valve connected in the said further conduit.

6. Breathing apparatus according to claim 1 further comprising means including a pressure reducing primary pressure regulator connected in series in said conduit and a current restricting throttle connected in series in said conduit for providing filling of the dosing bottle from a gas container during the first operating period.

7. Breathing apparatus according to claim 1 further comprising a valve located in the breathing circuit which is maintained closed during the second operating period, fresh gas from the dosing bottle supplied to a point in the breathing circuit downstream from said valve.

8. Breathing apparatus according to claim 7 wherein an exhalation valve for consumed breathing gas is disposed in the breathing circuit upstream from the first-named valve.

* * * * *